US006076710A

United States Patent [19]

Yates et al.

[11] Patent Number: 6,076,710

[45] Date of Patent: Jun. 20, 2000

[54] CONCRETE PLACEMENT APPARATUS

[75] Inventors: Steve Lee Yates; C. Terry Funderburk, both of China Grove, N.C.

[73] Assignee: Yates-Funderburk Concrete Finishing, Inc., China Grove, N.C.

[21] Appl. No.: 09/184,204

[22] Filed: Nov. 2, 1998

[51] Int. Cl.[7] ..... B67D 5/06

[52] U.S. Cl. ..... 222/491; 222/526; 222/537; 222/566

[58] Field of Search ..... 222/566, 567, 222/491, 526, 533, 537, 611.2; 239/379; D15/19

[56] References Cited

U.S. PATENT DOCUMENTS

| | | | |
|---|---|---|---|
| 508,307 | 11/1893 | Haagen | 222/537 X |
| 3,046,025 | 7/1962 | Vissers | 222/533 X |
| 3,162,886 | 12/1964 | Wise | 222/611.1 X |
| 4,043,487 | 8/1977 | Price | 222/611.2 X |
| 4,907,916 | 3/1990 | Hartman | 405/236 |
| 5,026,214 | 6/1991 | Beck, III | 405/240 |
| 5,536,151 | 7/1996 | Von Eckardstein | 417/429 |

FOREIGN PATENT DOCUMENTS

| | | | |
|---|---|---|---|
| 1407902 | 7/1964 | France | 222/566 |

*Primary Examiner*—Kenneth Bomberg
*Attorney, Agent, or Firm*—Dougherty & Associates

[57] ABSTRACT

An improved method and apparatus for distribution of viscous materials such as concrete slurry or grout mixtures onto target surfaces, the apparatus connectable to a transfer pipe leading from an external pumping mechanism. The method and apparatus includes a generally rectangular chamber having walls providing an upper wall attached to a conduit, the conduit connectable to a transfer pipe by a pivotable annulus or ring. The pivotable annulus provides rotation of the chamber in approximately 360° range of motion in relation to the transfer pipe. As the concrete slurry or grout mixtures are pumped through the chamber by an external pumping mechanism, the walls direct the viscous materials out through an outlet, formed in a lower portion of the front wall, the outlet having an opening shaped for directing the viscous materials toward target surfaces. The improved method and apparatus provides an efficient distribution device that is easily maneuverable with attached handles by an operator for placement and distribution of concrete slurries or grout mixtures on target surfaces or into target enclosures.

13 Claims, 1 Drawing Sheet

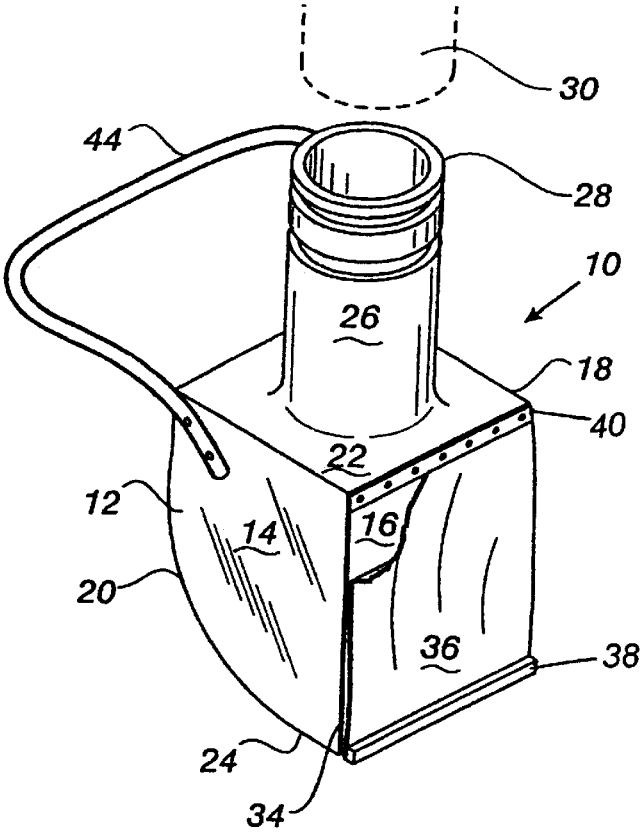
Fig.1
Fig.2
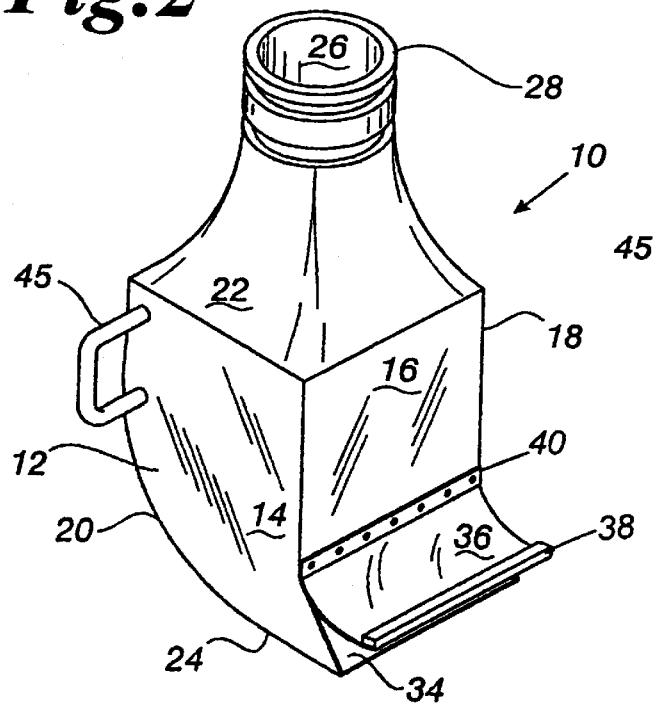
Fig.3
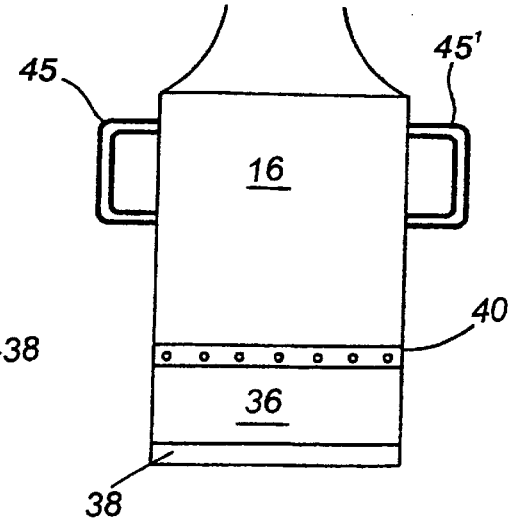

CONCRETE PLACEMENT APPARATUS

FIELD OF THE INVENTION

The present invention relates to a method and apparatus for pumping viscous materials, and more particularly to apparatus and methods for placement of concrete slurry materials on a target surface.

BACKGROUND OF THE INVENTION

The invention relates to the pumping and transfer of concrete inert other viscous slurry mixtures from a pumping and concrete mixing truck to application on a target surface. The prior art describes methods and apparatus for transfer of concrete from concrete mixing and pumping equipment, with the transfer accomplished by pipes, conduits and hoses which generally direct concrete mixtures to a target surface or into an enclosure with ample waste due to spillage. The prior method of placement of concrete onto a surface included an operator directing the tube outlet of a pipe toward a target surface, with ample splatter. Patents which describe the prior art include U.S. Pat. No. 5,536,151 to von Eckardstein, which describes a device for the pneumatic delivery of concrete to a surface by the use of a pump, pipes and a distribution valve for dosing agents. The outlet of the '151 patent is a typical pipe or other conduit utilized for the transfer of concrete slurry mixtures. For U.S. Pat. No. 5,026,214, to Beck, the apparatus and method describe a concrete pumping truck which places an extendable hose down into a bored cavity in the ground with transfer of concrete slurry mixtures down a pipe to an outlet point which has outlet holes to allow seepage of the concrete slurry mixture into the cavity being filled. U.S. Pat. No. 4,907,916 to Hartman, discloses a pipe and a method of forcing pressurized grout through the pipe and into a subsurface volume with the grout being released through outlet holes in the end of the pipe in the subsurface. Additional art exists which describe apparatus and methods providing transfer of concrete slurry mixtures through pipes, hoses and other similar conduits to cylindrical outlet pipes for essentially free, non-controllable release of the concrete slurry mixture toward the target surface. When concrete slurry mixtures are directed at target surfaces from an appreciable height, the force of the impact of the concrete slurry may break or bend heat pipes or plumbing pipes within the target surface receiving concrete slurry mixtures.

SUMMARY OF THE INVENTION

The invention provides an apparatus that fits on the end of a pipe, hose or conduit utilized for movement of concrete slurry or grout mixtures from a pumping unit to a target surface. During normal operation, the invention fits on the end of the pipe and provides a concrete slurry or grout mixture directional device. The directional device allows an operator to place concrete or grout mixtures on or in target surfaces with an ease of handling, a reduction in wastage, and increased efficiency that is not provided for in prior devices within the concrete and grouting industry.

The present invention is particularly useful for directing concrete slurry or grout mixtures that exit a pipe or conduit from a concrete pumping mechanism, with the direction of the exiting concrete or slurry material directed by the invention in a manner that is consistently toward the target surface or into an enclosure as directed by the operator. The force of the concrete or slurry material exiting the concrete placement apparatus is lessened, therefore reducing destructive impact at the target surface, and reducing waste from splatter of concrete or slurry material. The apparatus consists of a chamber having walls, the chamber walls enclosing the chamber with the upper walls of the chamber connectable to a concrete transfer pipe, with the walls of the chamber directing the concrete slurry or other viscous materials from the transfer pipe toward the target surface. A conduit and a rotatable annulus is connected at the top of the upper walls of the chamber with the annulus attachable to the conduit and the annulus rotating around the conduit providing a rotatable chamber. The chamber has an outlet that is formed in a lower portion of the chamber walls, with the outlet having an opening shaped for directing the concrete slurry or other viscous materials through the outlet and toward the target surface.

OBJECTS OF THE INVENTION

The principal object of the present invention is to provide an improved method of placement of concrete slurry or other viscous materials onto a target surface.

A further object of this invention is to provide a method of directing concrete slurry or other viscous materials from a pumping mechanism and piping to a target surface.

Another object of the invention is to provide an apparatus for directional placement of concrete slurry with the apparatus having the ability to rotate as the concrete slurry or other viscous materials is placed on or in a target surface.

A further and more specific object of the invention is to provide a method of directional placement of concrete slurry or other viscous materials, with a method providing ease of operation by the operator and allowing for efficient placement of concrete onto a target surface without wastage or excess splatter of concrete slurry material or other viscous material.

The objects of the invention are accomplished by an apparatus and a method which provides an apparatus having a chamber and a conduit attached to the chamber, plus a pivotable annulus attachable to the conduit, with the chamber being pivotable around a connecting transfer pipe for direction and channeling of concrete slurry and other viscous material through the chamber to an outlet of the chamber, with the outlet directing concrete slurry material toward and onto the target surface.

BRIEF DESCRIPTION OF THE DRAWINGS

The foregoing and other objects will become more readily apparent by referring to the following detailed description and the appended drawings in which:

FIG. 1 is an isometric view of an embodiment of the chamber and outlet of the present invention;

FIG. 2 is a isometric view of another embodiment of the chamber and outlet for directing concrete slurry material onto a target surface; and FIG. 3 is a front elevation view of the invented apparatus having a chamber and an outlet for directing concrete slurry material onto a target surface.

DETAILED DESCRIPTION

Referring now to the drawings, and particularly to FIG. 1, the invented concrete slurry directional device 10 includes a chamber 12 having four walls 14,16,18,20, which form an enclosure having an interior that has two sides 14,18 that extend to a lower extension of the front wall 16. The overall exterior dimensions of film the chamber walls 14,16,18,20 may be 1 to 1½ feet deep, 1 foot wide, and 1½ to 2 feet high. The dimensions may vary by ½ to 1 foot, due to the application of the device 10 in limited space enclosures or outdoor areas. The chamber 12 includes a top surface 22 and forms an enclosed interior volume that forms the bottom surface 24 of the chamber 12. The bottom surface 24 may extend outwardly from the back surface 20 toward the front surface 16 in an arcuate or curved shape (see FIG. 2). The interior seams of the walls 14,16,18,20 are welded seams and have internal braces along and congruent with each wall corner to provide interior supports for the chamber 12. At the top of the chamber 12 is a conduit 26 which is attached to the top surface 22 of the chamber 12. The conduit 26 is partially raised above the top surface 22, with the conduit 26 formed in a generally circular shape to allow the conduit 26 to connect to a pipe or hose 30 that is connected to concrete slurry or grout mixture pumping equipment (not shown). The connection of the pipe 30 to the conduit 26 is by means of any commonly used connector, including a pivotable annulus ring connector 28 with the annulus ring connector 28 providing a rotating connection allowing the chamber 12 and conduit 26 to be rotated in a 360° range of motion in relation to the central axis of the pipe 30 when connected to the annulus ring 28 which is centered around the central axis of the conduit 26.

The concrete slurry or viscous material is pumped by the pumping equipment through the transfer pipe 30, through the conduit 26 and into and down through the interior void area 32 of the chamber 12. The flow rate is controlled by the pumping equipment operator. The concrete is channeled down and toward an outlet 34 in the bottom area of the front surface 16. The outlet 34 is an opening for the concrete slurry or other viscous material to exit the chamber 12 with the outlet 34 providing a method of shaping the exiting slurry material in a rectangular or other shape depending on whether the outlet 34 is a rectangular outlet, circular outlet, or other geometric shape. The bottom surface 24 of the chamber 12 extends forward and past outward the front surface 16 allowing the lower portion of the outlet 34 to channel the concrete slurry mixture toward the target surface (not shown). A replacement plate or bottom surface (not shown) may be welded onto the bottom surface 24 or spot welded onto the bottom surface 24 to provide additional support of the concrete slurry material exiting the outlet 34. The outlet 34 may be covered by a pivoting flap or cover 36 with the upper edges of the flap or cover pivoting on a pair or hinges 40 attachable at the mid-point of front surface 16, or attachable to the lower section of the front surface 16, with the flap or cover 36 pivoting up and away from the outlet 34. The flap 36 provides a cover for the concrete slurry or other viscous material when the pumping mechanism is not forcing concrete slurry material through chamber 12. The flap or cover 36 may be flexible or rigid depending on whether the viscous material exiting outlet 34 is smooth low viscous material (rigid cover is possible) or is concrete slurry type material having rocks and granular components within the slurry material (flexible cover is utilized). The flap or cover 36 may be constructed of heavy rubber, heavy gauge canvas, or metal. The flap or cover 36 may have a heavy metal bar 38, possibly of lead, attached across the lower surface of the cover 36, to allow the flap to close by its own weight.

The sides 14,18 may have at least one handle 44 attached to each side with the handle shaped in a curving member from one side 14 to the opposing side 18. Separate handles 45,45' may also be attached to each side 14,18 or to the rear surface 20 to provide a gripping mechanism for the operator to direct the chamber 12 toward the target surface and allowing the operator to swivel the chamber 12 around the pivotable annulus ring 28 in relation to the transfer pipe 30. The chamber 12 and walls 14,16,18,20 and conduit 26 may be made of any sturdy material such as steel or composite materials providing rigidity. The flap or cover 36 may be made of flexible material such as a rubber flap, heavy canvas, or high density plastic material, or may be of a rigid material such as aluminum or steel with the flap 36 having a pair of hinges 40 which connect the upper end of the flap 36 to the lower segment of the front surface 16 which allows the flap 36 to rotate down to cover the outlet 34 when viscous materials are not pumped through the outlet 34, or the flap or cover 36 may be forced open by the pressure of the viscous material being channeled through outlet 34. The interior trough 38 which is formed into the floor 24 of the chamber 12 provides additional directional capability for the interior void area of the chamber 12 to direct viscous material down and through the chamber 12 and out the outlet 34 in a directed manner. The interior surfaces of walls 14,16,18,20 are smooth and may curve from the upper surface 22 down toward the lower front surface 16 providing a smooth interior transfer surface, efficient movement of viscous materials through the chamber 12, and out the outlet 34 without buildup or hangup of viscous material within the chamber 12.

The overall shape of the chamber 12 may be rectangular or square or a trapezoid type shape with the forward jutting edge of a trapezoid shape being the front leading and lower surface 16 including the outlet 34.

ALTERNATIVE EMBODIMENTS

Alternative embodiments of the invention include having an intake conduit 26 on an upper side of one of the side surfaces 14,18 or the rear surface 20. Another embodiment may provide a top of chamber 12 forming a large inlet with a minimal flat surface 22 around a large inlet conduit 26. An additional embodiment may provide an outlet 34 forming a downward exit of viscous material from the bottom surface 24 of the chamber 12. Another embodiment may have two or more hand grips 45,45' connected to each of the side walls 14,16,18,20 to allow an operator to grip any of the side walls for moving the chamber 12 in a lateral motion, or for moving chamber 12 in a vertical motion, and allowing rotation of chamber 12 by gripping any of the handgrips 45,45'. An additional embodiment may provide a second outlet (not shown) either on the bottom surface 24 or placed on the lower part of the back surface 20, or placed on either or both of the lower parts of sides 14,18. The second outlet would provide an additional opening for viscous materials separate from outlet 34 with a separate flap or cover on the additional opening, the cover sealable by the operator depending on the amount of slurry material that the operator seeks to release above a target surface. The chamber 12 may also be fitted with an interior or exterior valve that controls the flow of the inlet viscous material through conduit 26, or a valve that is interior to the chamber 12 that limits the flow of slurry material out of outlet 34 or out of an additional outlet provided in chamber 12.

SUMMARY OF THE ACHIEVEMENT OF THE OBJECTS OF THE INVENTION

From the foregoing, it is readily apparent that we have invented an improved method and apparatus for directing a viscous material such as concrete slurry or grout mixtures onto a target surface. The directional apparatus fits on the end of a typical transfer hose or pipe and provides a device and method of operation to allow an operator to economically and efficiently direct viscous materials onto a target surface or into a target container. The invented apparatus provides for improved placement and direction of viscous material with operation by one operator of the apparatus in a manner that is more efficient, and provides placement of viscous materials with less destructive impact onto the target surface, than heretofore had been possible by a transfer pipe without a device for directing viscous material.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. An apparatus for distribution of viscous materials from a connectable transfer pipe to a target surface, comprising:

a chamber having walls, said chamber walls having an upper wall with an opening therein, said walls direct said viscous materials from said upper wall opening toward said target surface;

a conduit, said conduit attached to said upper wall opening, said conduit having an annular opening connectable to said transfer pipe;

a connector, said connector attachable to said conduit and said transfer pipe; and an outlet, said outlet formed into a lower portion of said chamber walls, said outlet having an opening shaped to direct said viscous materials toward said target surface.

2. The apparatus of claim 1, wherein said connector further comprises a pivotable annulus, said annulus attachable to said conduit and said transfer pipe, said annulus pivotable around said conduit.

3. The apparatus of claim 2, wherein said chamber walls further comprise:

a generally rectangular chamber, said rectangular chamber having a front and a back wall forwardly curved toward said outlet, said outlet formed in said front wall;

a floor surface of said rectangular chamber, said floor surface extended forward toward said front wall and said outlet; and a handle connectable to said upper portion of said chamber walls, said handle connectable on at least one of a side wall of said chamber walls.

4. The apparatus according to claim 2, wherein said conduit having an annular opening further comprises a generally circular conduit, said annular opening receives viscous material from said transfer pipe connectable to said conduit, said conduit having a base opposite said attachable annulus, said base attached to said upper portion of said chamber walls.

5. The apparatus according to claim 2, wherein said pivotable annulus further comprises an attachable ring, said ring allows rotation in a range of about 360° of said conduit and said chamber in relation to said connectable transfer pipe.

6. The apparatus according to claim 2, wherein said outlet further comprises a generally rectangular opening, said outlet in a front wall of said chamber walls, said outlet having a cover flap hingeably attachable at a top portion of said cover flap, to said lower portion of said chamber walls.

7. The apparatus according to claim 2, wherein said outlet comprises a generally cylindrical opening, said outlet in a front wall of said chamber walls, said outlet having a cover flap hingeably attachable at a top portion of said cover flap, and to said lower portion of said chamber walls.

8. The apparatus according to claim 2, wherein said outlet formed into a lower portion of said chamber walls, said lower portion including a floor of said chamber, said floor curved toward said outlet, said curved floor directs said viscous materials toward said shaped opening.

9. An apparatus for distribution of viscous materials from a connectable transfer pipe to a target surface, comprising:

a chamber having walls, said chamber directing said viscous materials from said transfer pipe toward said target surface;

a conduit, said conduit attached to an upper portion of said chamber walls, said conduit having an annular opening;

a rotatable connector, said connector attachable to said annular opening, said transfer pipe connectable to said connector in close proximity to said annular opening, said connector rotatable around said conduit;

an outlet, said outlet formed in a lower portion of said chamber walls, said outlet having an opening shaped to direct said viscous materials toward said target surface; and a means for pumping said viscous material through said conduit, said chamber, and said outlet toward said target surface.

10. The apparatus of claim 9, wherein said chamber walls further comprise:

a generally rectangular chamber, said rectangular chamber having a front and a back wall forwardly curved toward said outlet, said outlet formed in a lower portion of said front wall;

a floor surface of said rectangular chamber, said floor surface extended forward toward said lower portion of said front wall and said outlet; and a handle connectable to said upper portion of said chamber walls, said handle connectable on at least one of a side wall of said chamber walls.

11. The apparatus according to claim 9, wherein said conduit having an annular opening further comprises a generally circular conduit, said annular opening receives viscous material from said transfer pipe connectable to said conduit, said conduit having a base opposite said attachable annulus, said base attached to said upper portion of said chamber walls.

12. The apparatus according to claim 9, wherein said rotatable connector further comprises an attachable ring, said ring allows rotation in a range of about 360° of said conduit attached to said upper portion of said chamber walls in relation to said connectable transfer pipe.

13. The apparatus according to claim 9, wherein said outlet further comprises a generally rectangular opening, said outlet in a front wall of said chamber walls, said outlet having a cover flap hingeably attachable at a top portion of said cover flap, and to said lower portion of said chamber walls.

* * * * *